US006015201A

United States Patent [19]

Asakura

[11] Patent Number: 6,015,201

[45] **Date of Patent: *Jan. 18, 2000**

[54] INK JET RECORDING APPARATUS FOR PREVENTING SMEARING OF IMAGES

[75] Inventor: Osamu Asakura, Sagamihara, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/542,788

[22] Filed: Oct. 13, 1995

[30] Foreign Application Priority Data

Oct. 18, 1994 [JP] Japan ..... 6-252170

[51] Int. Cl.[7] ..... B41J 29/38; B41J 29/393; B41J 2/01

[52] U.S. Cl. ..... 347/19; 347/16; 347/102

[58] Field of Search ..... 347/16, 19, 102, 347/14

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 5,317,002 | 5/1994 | Onishi | 503/227 |
| 5,638,098 | 6/1997 | Iwata et al. | 347/9 |
| 5,648,807 | 7/1997 | Saito et al. | 347/102 |

FOREIGN PATENT DOCUMENTS

| | | |
|---|---|---|
| 54-056847 | 5/1979 | Japan . |
| 59-123670 | 7/1984 | Japan . |
| 59-138461 | 8/1984 | Japan . |
| 60-071260 | 4/1985 | Japan . |

*Primary Examiner*—Peter S. Wong
*Assistant Examiner*—Bao Q. Vu
*Attorney, Agent, or Firm*—Fitzpatrick, Cella, Harper & Scinto

[57] ABSTRACT

An apparatus for recording an image by discharging an ink droplet to a recording medium includes a timer for setting a predetermined time in accordance with the type of the recording medium so that the recording operation is interrupted or conveyance of the recording medium is interrupted during the predetermined time in order to prevent contact between a previously discharged recording medium and a recording medium which is being discharged so that generation of smear and adhesion between recorded recording mediums are prevented regardless of the type of the recording medium.

32 Claims, 13 Drawing Sheets

FIG. 4

FORMAT

PAPER SIZE: B5 LONGTITUDE | A4 LONGTITUDE | B4 LONGTITUDE | A3 LONGTITUDE
B5 LATERAL | A4 LATERAL | B4 LATERAL | A3 LATERAL
POSTCARD LONGTITUDE | POSTCARD LATERAL | POSTCARD HAVING PICTURE LONGTITUDE | POSTCARD HAVING PICTURE LATERAL
DOCUMENT A4 | DOCUMENT B4 | FREE
LATERAL SIZE [210]mm
LONGITUDE SIZE [297]mm

NUMBER OF LETTERS PER LINE: [36] LETTERS (MAXIMUM = 56)
NUMBER OF LINES PER PAGE: [29] LINES (MAXIMUM = 72)
ORIENTATION: LATERAL WRITING | LONGITUDINAL WRITING
JAPANESE STYLE PRINTING: ON | OFF
ALPHABETIC PRINTING: OFF | 10 PITCHES | 12 PITCHES
FONT SIZE GROUP: 0 | 1 | 2 | 3
LARGEST FONT SIZE
SMALL 7 POINT | MEDIUM 10.5 POINT | LARGE 12 POINT

16 : 07

SETTING | DETAILED SETTING | HEADER/FOOTER

FIG. 5

PRINT

■ NUMBER OF PRINTS [ 16 ] PRINTS

☐ PARTIAL PRINTING [ 0 ] PAGE (0 = PRINT ALL PAGES, 1~99 = PRINT PAGES FROM LINE ON WHICH CURSOR IS PLACES)

| | | | |
|---|---|---|---|
| ☐ PRINTING SPEED | NORMAL | HIGH SPEED | |
| ☐ RECIPROCATING PRINTING | OFF | ON | |
| ☐ PRINT FONT | MINCHO TYPEFACE | SECOND FONT | (NO CARD) |
| ☐ COMMENT | OFF | ON | |
| ☐ HALF SIZE CHARACTER CENTERING | OFF | ON | |
| ☐ FIXING MODE | OFF | ON | |
| ☐ SIZE REDUCTION MODE | OFF | ON | |
| ☐ PAPER | PLAIN PAPER | OHP PAPER | POSTCARD HAVING PICTURE SEAL |

☐ DOCUMENT NAME TO BE INSERTED [ ]

16 : 03

PRINT | | RESTART | INTERRUPT | INSERTION PRINT | LAYOUT | | FORMAT SETTING

| FIG. 11A |
| --- |
| FIG. 11B |

INK JET RECORDING APPARATUS FOR PREVENTING SMEARING OF IMAGES

BACKGROUND OF THE INVENTION

1. Field of the Invention

The present invention relates to a recording apparatus for use as an information output apparatus for a word processor or a personal computer or an image forming apparatus such as a copying machine or a facsimile apparatus, and more particularly to a recording apparatus for recording information by discharging ink droplets to a recording medium in accordance with information to be recorded.

2. Related Art

In recent years, so-called ink jet recording apparatuses (ink jet printers) for recording information by discharging liquid ink to a recording medium in accordance with information to be recorded have been used widely because of high quality recorded results, high recording speed, excellent adaptability to a variety of recording sheets and low noise.

Ink to be used in the ink jet recording apparatus usually contains water soluble dye or pigment, the ink discharged to a recording sheet being then allowed to penetrate and be absorbed by the recording sheet and the solvent of the ink being then evaporated so that the ink is fixed.

The fixing process takes a time which is determined by the type of the ink, the recording density, the type of the recording sheet, and the environment, such as the temperature and the humidity.

Therefore, if information is, on a hot and wet day, recorded at a high recording density on a recording sheet, such as a transparent sheet for an overhead projector (OHP), which does not considerably absorb the ink, an excessively long time is required to fix the ink. As a result, if a plurality of sheets are recorded, the recorded second and third sheets are discharged onto the previous recording sheet recorded and discharged from the recording portion, thus causing the recording surfaces, which have not been fixed, to be brought into contact with the other sheets. Thus, the recording surfaces are rubbed and bleeding occurs. Furthermore, ink adheres to another sheet, as a result of which the sheet is contaminated or so-called smear takes place.

Also in a case where a member for guiding the recording sheet, which comes in contact with the recording surface of the recording sheet, is disposed from the recording portion to the discharge port for the recording sheet, similar smear takes place.

To prevent occurrence of the smear, a variety of methods have been disclosed, for example, a method using a heater for heating the recording sheet to enhance fixation of the ink, a method in which the recording density is detected to delay the discharge of the sheet for a predetermined time if the density is too high, and a method in which a means for setting a predetermined delay time during the recording operation is provided.

There arises a desire for a recording apparatus, and more particularly, a great desire arises for recording information on a variety of recording sheets.

Recently, postcards of a type having a photograph sheet thereon formed by applying a photograph sheet to the reverse side of a postcard have been put into practical use.

Although the postcard having a photograph sheet thereon has been too thick to be recorded by a conventional recording apparatus, recording can be performed by improving the mechanism for feeding the recording sheet.

However, if an ink jet recording apparatus continuously records a plurality of postcards, each having a photograph sheet thereon, continuous recording of a plurality of the postcards results in the recorded postcards being stacked in the discharge portion of the recording apparatus. As a result, the recording surface of the first postcard and the surface of the photograph sheet on the second postcard are brought into contact with each other or the recording surface of the second postcard and the surface of the photograph sheet on the first postcard are brought into contact with each other. Thus, the foregoing problem of smear generation and other problems will arise.

In addition to the known smear, such as bleeding and contamination of the recorded image, another problem was confirmed that a solvent evaporating from the ink absorbed by the recording surface of a recording medium is absorbed by the surface of a photographic emulsion surface of a silver salt photograph forming a photograph sheet that is in contact with the foregoing recording surface, causing the surface of the photograph sheet to be softened and adhesion to take place between the photograph sheet and the recording surface.

The foregoing problem of adhesion cannot be overcome by the conventional methods of preventing the smear. The reason for this is that, even if the ink has been absorbed by the recording sheet and fixed to a degree that does not generate the smear, evaporation of the solvent from the ink absorbed by the recording sheet is further performed.

A recording sheet of a type formed by applying glue of the same type that is used for postcards to the reverse side of the recording sheet may be employed in the form of a seal. Also the recording sheet of the foregoing type will raise a similar problem to that experienced with the postcard having a photograph sheet.

More particularly, the foregoing method of preventing smear has been established in consideration of the condition of the recording surface to which ink has been discharged but the method is not established in consideration of the surface of the recording sheet that comes in contact with the recording surface. Therefore, the foregoing adhesion phenomenon occurring due to the state of the surface of the recording sheet that comes in contact with the foregoing recording surface cannot be prevented.

SUMMARY OF THE INVENTION

Accordingly, an object of the present invention is to provide an improved recording apparatus.

Another object of the present invention is to provide a recording apparatus capable of preventing smear and adhesion even if a recorded recording medium is placed on the previously discharged recording medium, regardless of the type of the recording medium.

Another object of the present invention is to provide a recording apparatus capable of preventing adhesion or the like caused due to stacking of recording mediums at the time of recording information on a recording medium having a surface provided with a photograph sheet.

Another object of the present invention is to provide a recording apparatus arranged to set a predetermined time in accordance with the type of the recording medium to prevent contact between a surface of a recorded recording medium and a surface of a discharged recording medium, and to control a recording operation or a discharge operation in accordance with the thus-set predetermined time so as to prevent smear and adhesion between recording mediums regardless of the type of the recording medium.

Another object of the present invention is to provide a recording apparatus arranged in such a manner that, if a recording medium having a surface provided with a photograph sheet is selected, the discharge interval of the recorded recording mediums is elongated as compared with the interval set for a case where another recording medium is selected to prevent adhesion or the like even if the recording surface of the discharged recording medium comes in contact with the surface of the photograph sheet of the recording medium.

Other and further objects, features and advantages of the invention will be evident from the following detailed description of the preferred embodiments in conjunction with the attached drawings.

BRIEF DESCRIPTION OF THE DRAWINGS

FIG. 4 is a diagram showing a format setting menu of the word processor according to the embodiment of the present invention;

FIG. 5 is a diagram showing a print menu screen for the word processor according to the embodiment of the present invention;

DETAILED DESCRIPTION OF PREFERRED EMBODIMENTS

Preferred embodiments of the present invention will now be described with reference to the drawings.

First Embodiment

Figure 1:
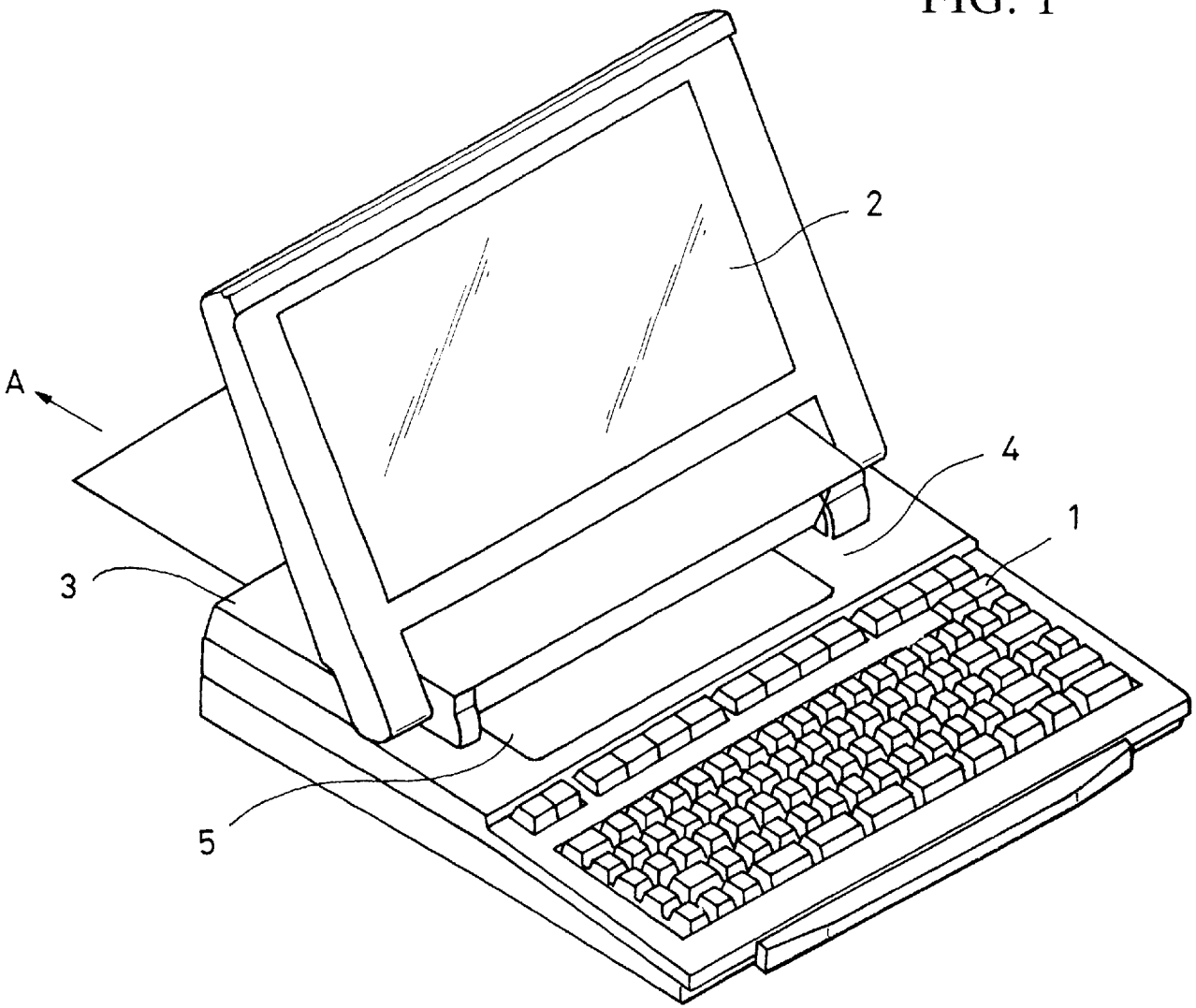
FIG. 1 is a perspective view showing the structure of a word processor serving as an example of an apparatus to which the present invention is adapted.

FIG. 1 is a perspective view showing the shape of a word processor serving as an information output apparatus including a recording apparatus according to the present invention.

Referring to FIG. 1, the word processor according to this embodiment comprises a keyboard 1 for inputting information, a display unit 2 comprising liquid crystal or the like for displaying information, a recording apparatus (a printer) 3 for recording information on a recording sheet, and an opening portion 4 for inserting the recording sheet into the recording apparatus 3. Reference numeral 5 represents a recording sheet, which is inserted through the opening portion 4 and discharged in a direction indicated by an arrow A shown in FIG. 1.

Figure 2:
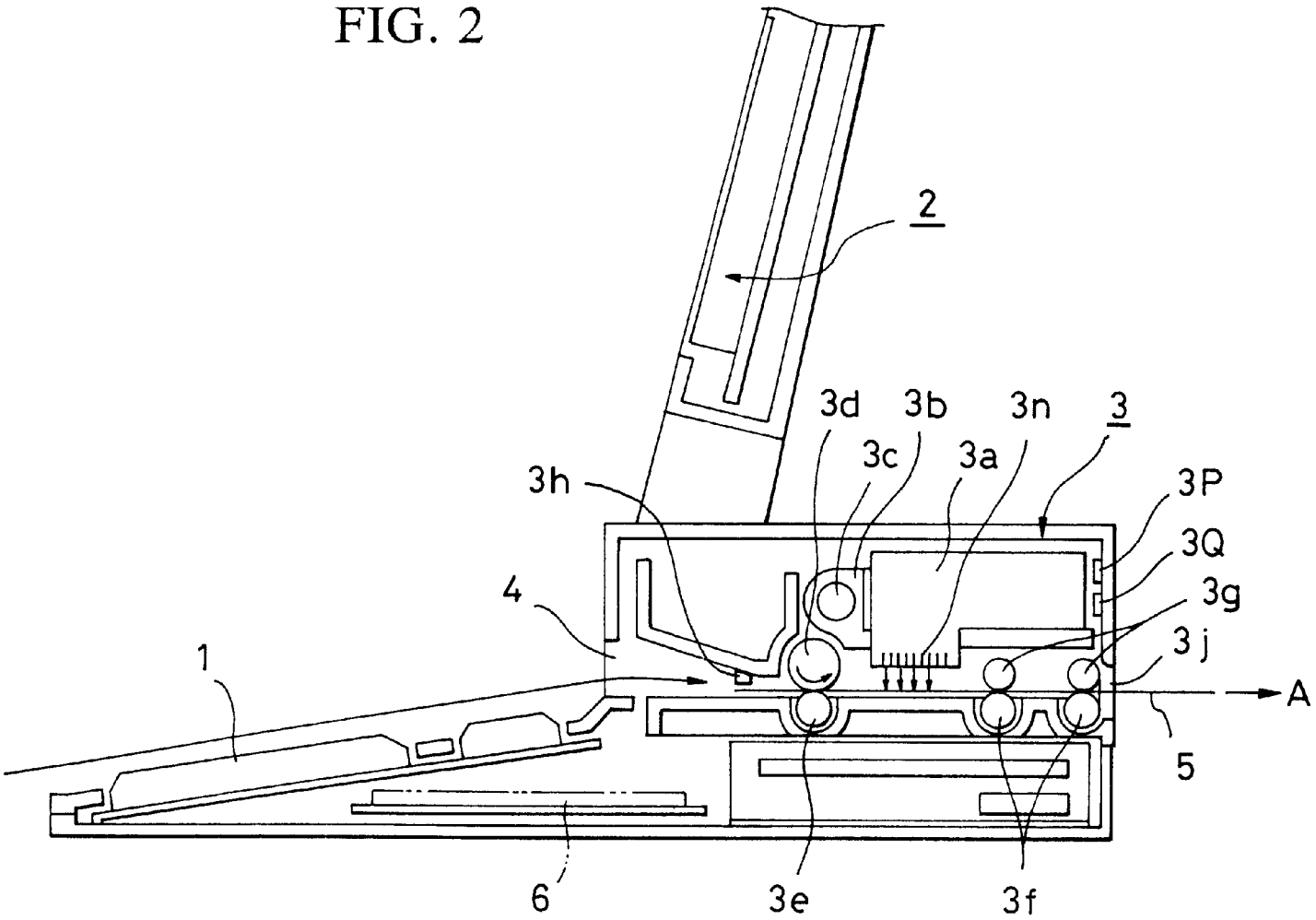
FIG. 2 is a cross sectional view showing the word processor according to an embodiment of the present invention.

FIG. 2 is a cross sectional view showing the word processor shown in FIG. 1.

Referring to FIG. 2, reference numeral 3*a* represents an ink jet recording head mounted on a carriage 3*b* which is guided by a guide shaft 3*c* disposed perpendicular to a direction, in which the recording sheet 5 is moved, and which is indicated by the arrow A, the carriage 3*b* being thus allowed to reciprocate.

Reference numeral 3*n* represents a recording nozzle group disposed in the ink jet recording head 3*a* at a position opposing the recording sheet 5, the recording nozzle group 3*n* consisting of a plurality of recording nozzles arranged in parallel to the direction A, in which the recording sheet 5 is moved. The recording nozzles 3*n* are allowed to reciprocate by the carriage 3*b* to discharge liquid ink to the recording sheet 5 to record information.

Note that the ink jet recording head 3*a* according to this embodiment uses thermal energy to change the state of the ink to cause ink droplets to be discharged through the recording nozzles 3*n*.

Reference numeral 3*d* represents a roller for feeding the recording sheet 5 in such a manner that it cooperates with a pinch roller 3*e* depressed by the sheet-feeding roller 3*d* so as to convey the recording sheet 5 inserted through the opening portion 4.

Reference numeral 3*f* represents a paper-discharge roller which is rotated in synchronization with the sheet-feeding roller 3*d* at substantially the same speed, the paper-discharge roller 3*f* being disposed to oppose a spur roller 3*g* with respect to the recording sheet 5. The paper-discharge roller 3*f* discharges, toward a discharge port 3*j*, the recording sheet 5 recorded at a position opposing the recording nozzles 3*n* of the ink jet recording head 3*a*.

Reference numeral 6 represents a control portion for processing information input from the keyboard 1, causing the display unit 2 to display the information, and causing the recording apparatus 3 to record the information on the recording sheet 5.

Figure 3:
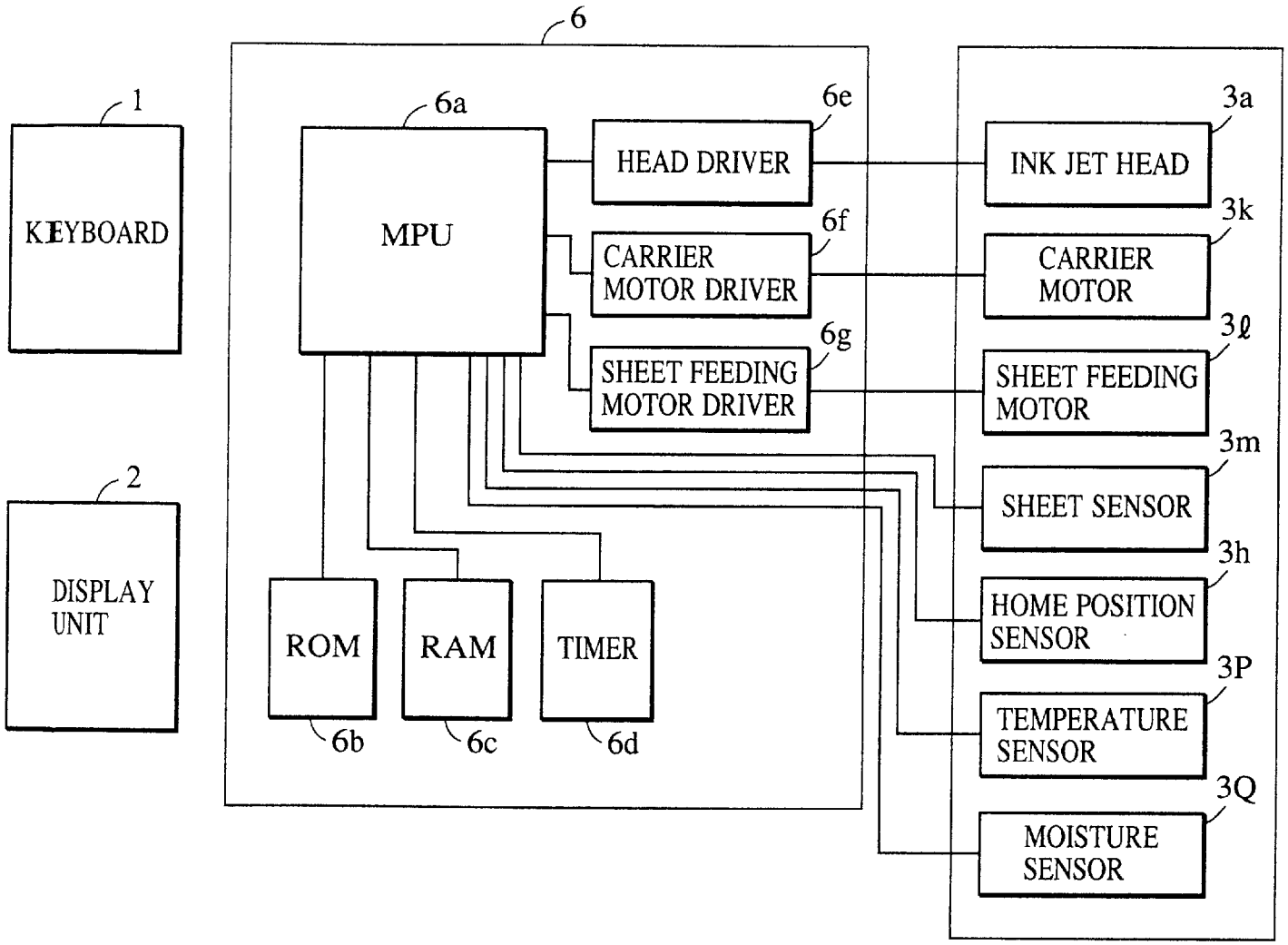
FIG. 3 is a block diagram showing the word processor according to the embodiment of the present invention.

FIG. 3 is a block diagram showing the word processor according to this embodiment.

The control portion 6 comprises an MPU 6*a* for totally controlling the word processor, a ROM 6*b* for storing a program for control which is performed by the MPU 6*a*, a RAM 6*c* having, e.g. a storage area for storing information to be recorded and a work area for temporarily storing data, a timer 6*d*, a head driver 6*e* for driving the ink jet recording head 3*a*, a carrier motor driver 6*f* for rotating a carrier motor 3*k* for reciprocating the carriage 3*b*, and a sheet-feeding driver 6*g* for rotating a sheet-feeding motor 31 for operating the foregoing sheet conveyance system.

The recording apparatus 3, in addition to the ink jet recording head 3*a*, comprises a carrier motor 3*k*, the sheet-feeding motor 31, a sheet sensor 3*m* for detecting an end of the recording sheet 5 to set the leading portion of the recording sheet 5, a home-position sensor 3*h* for detecting a reference position for the carriage 3*b*, a temperature sensor 3*p* for detecting the temperature in the apparatus, and a moisture sensor 3*q* for detecting the humidity in the apparatus. The ink jet recording head 3*a* is connected to the head driver 6*e,* the sheet-feeding motor 31 is connected to the sheet-feeding driver 6*g,* and the sheet sensor 3*m,* the home-position sensor 3*h,* the temperature sensor 3*p* and the moisture sensor 3*q* are connected to the MPU 6*a.*

The recording operation to be performed by the word processor according to this embodiment will now be described.

When an information input function is selected by using the keyboard 1, "FORMAT SETTING" menu shown in FIG. 4 is displayed on the display unit 2.

After setting of the format, such as "PAPER SIZE" and the like, has been completed by using the keyboard 1, the display unit 2 displays an information inputting screen so that information, such as document information and/or image information, is input, and editing and processing are performed so as to produce information to be recorded.

The thus-produced information to be recorded is stored in the RAM 6*c.*

Then, the produced information is recorded on the recording sheet 5.

Initially, a printing function is selected by using the keyboard 1. After the printing function has been selected, the "PRINT MENU" shown in FIG. 5 is displayed on the display unit 2.

After "NUMBER OF PRINT" and the like in the printing menu have been set by using the keyboard 1, the recording sheet 5 is set at a predetermined position in the recording apparatus 3 through the opening portion 4 of the word processor, and then a "PRINT START" key of the keyboard 1 is depressed.

After the "PRINT START" key has been depressed, the MPU 6*a* of the control portion 6 activates the program stored in the ROM 6*b* to sequentially read information to be recorded and stored in the RAM 6*c* to operate the carrier motor driver 6*f* and the sheet-feeding driver 6*g* in accordance with the information to be recorded so as to rotate the carrier motor 3*k* and sheet-feeding motor 31. At the timing corresponding to the information to be recorded, the head driver 6*e* operates the ink jet recording head 3*a* so that an ink droplet is discharged to the recording sheet 5 to record the information.

After information for one page has been recorded, the sheet-feeding motor 31 is further rotated to rotate the sheet-feeding roller 3*d* and the paper-discharge roller 3*f* to move the recording sheet 5 in the direction indicated by the arrow A until the recording sheet 5 is discharged through the discharge port 3*j.* Thus, the recording sheet 5 is discharged.

If information to be recorded is information over a plurality of pages, or if a plurality of recorded sheets of the same information to be recorded for one page is required, a second recording sheet 5 and ensuing sheets are recorded subsequently to the operation of recording the first recording sheet 5.

Figure 6:
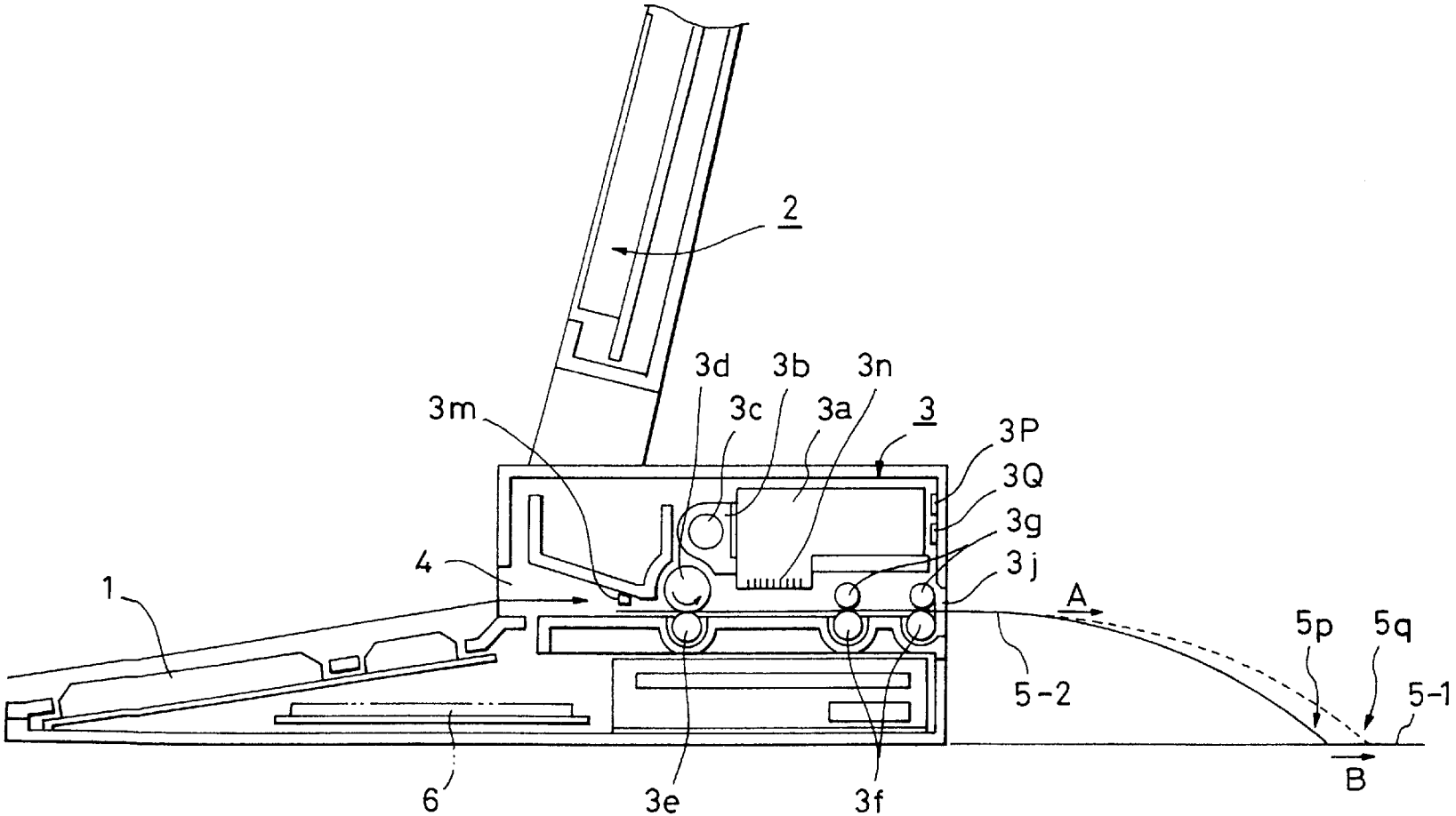
FIG. 6 is a cross sectional view showing a state where information is recorded on a recording sheet and the recording sheet is discharged in the word processor according to the embodiment of the present invention.

FIG. 6 shows a state where information is subsequently recorded on a plurality of recording sheets 5.

Referring to FIG. 6, reference numeral 5-1 represents a first recording sheet which has been recorded and discharged through the discharge port 3*j,* the recording sheet 5-1 being allowed to stand in the rear of the discharge port 3*j.*

Reference numeral 5-2 represents a second recording sheet which is being recorded subsequently to the recording sheet 5-1. As the recording process proceeds, the recording sheet 5-2 is moved in the direction indicated by the arrow A and its leading portion deflects downwards due to the dead weight thereof. At a point 5*p* of the first recording sheet 5-1, the recording sheet 5-2 is, for the first time, brought into contact with the recording sheet 5-1. The point of contact is moved in a direction indicated by an arrow B as indicated by a point 5*q* as the recording process proceeds.

In a case as indicated by the point 5*p* where time T from recording to contact at the point, at which the recording sheet 5 first comes in contact with another sheet after recording has been performed, is less than time TF required to absorb the discharged ink into the recording sheet 5, that is, T<TF, non-absorbed ink on the recording sheet 5-1 is rubbed so that recorded image encounters bleeding or non-absorbed ink on the recording sheet 5-1 adheres to the leading portion of the recording sheet 5-2, thus resulting in so-called smear taking place.

The time TF required to absorb the discharged ink into the recording sheet is determined by the type (the characteristics) of the recording sheet, the degree of dryness of the recording sheet and the recording density (the quantity of ink discharged to a certain point on the recording sheet).

To prevent smear, a method has been employed which, as shown in FIG. 5, comprises the steps of selecting the type of the recording sheet (the type of paper) from the printing menu; causing the MPU 6*a* to supervise the recording density at each point on the recording sheet; calculating the ink absorption time TF by using the foregoing two parameters; and performing control in such a manner that recording on the recording sheet 5-2 is interrupted or feeding of the recording sheet, such as the line breaking feeding of the recording sheet or discharge feeding, is delayed, if the contact time TF is T<TF.

Figure 7:
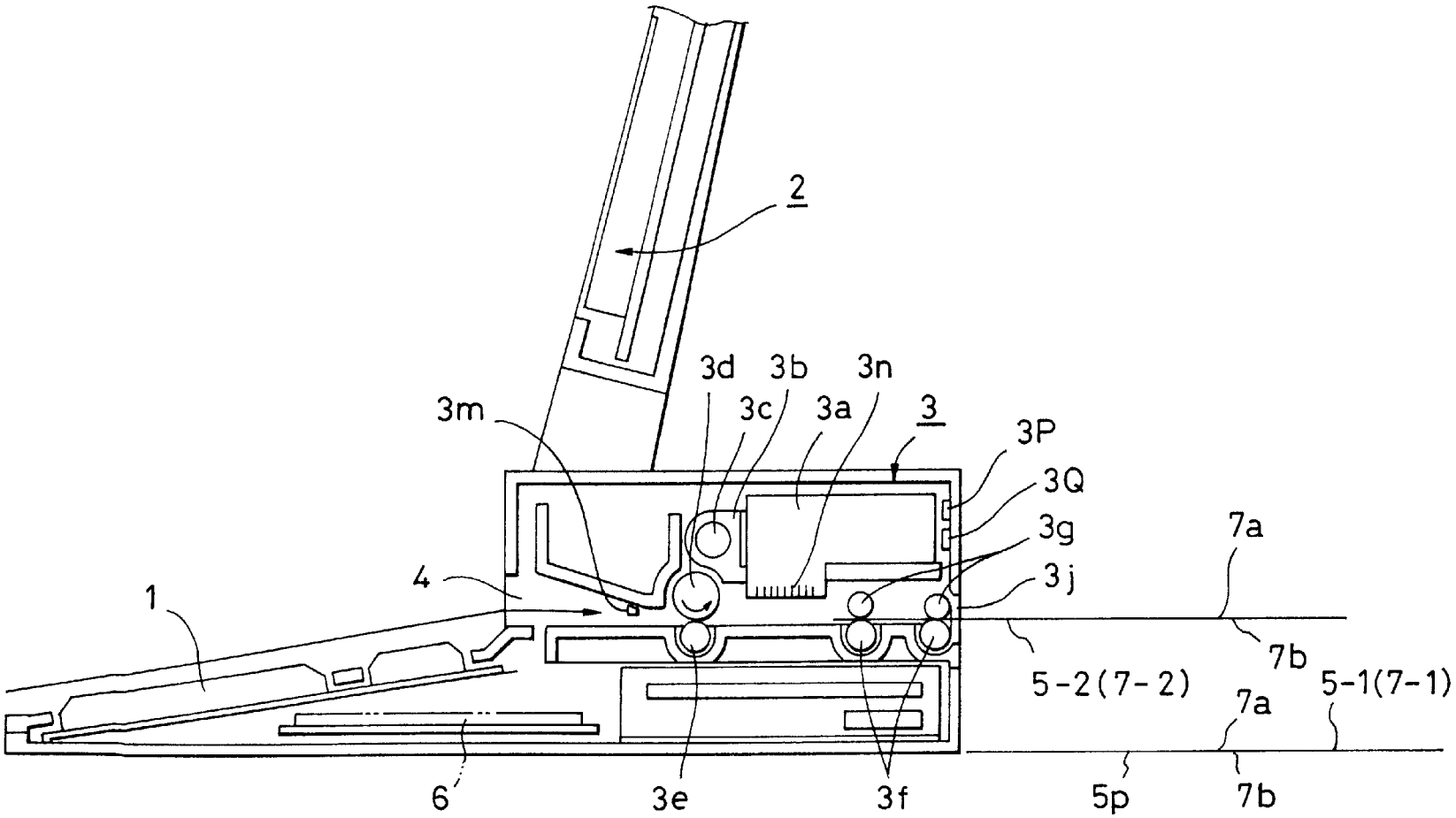
FIG. 7 is a cross sectional view showing a state where information is recorded on a photograph postcard and the recording sheet is discharged in the word processor according to the embodiment of the present invention.

FIG. 7 shows a case where thick paper, such as a postcard, is used as the recording sheet.

As shown in FIG. 7, the leading portion of the thick recording sheet does not deflect downwards to come in contact with the first recording sheet 5-1 because the thick recording sheet has strong rigidity. At a moment when the recorded second recording sheet 5-2 has been discharged through the discharge port 3*j,* the recording sheet 5-2 falls on the first recording sheet 5-1 in parallel to the first recording sheet 5-1. Therefore, the position, at which information is recorded on the recording sheet 5-1, is similar to 5*p.*

Figure 8:
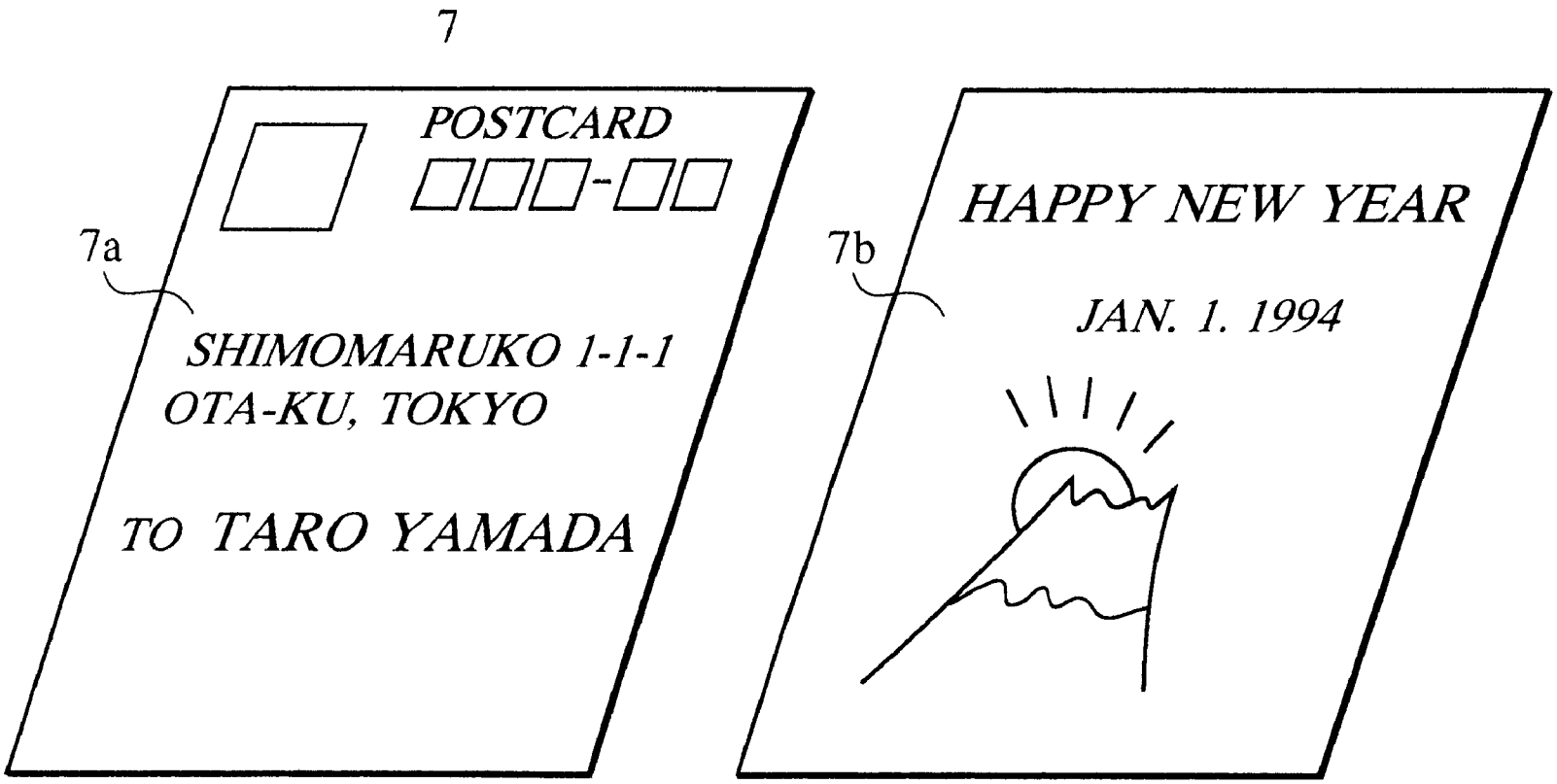
FIG. 8 is a perspective view showing a photograph postcard for use in the word processor according to the embodiment of the present invention.

FIG. 8 shows an example of a recording sheet having a photograph sheet provided on the reverse side thereof, in which there is shown a recording sheet (hereinafter called a photograph card 7) formed by applying a photograph sheet to the reverse surface of a postcard.

Referring to FIG. 8, reference numeral 7*a* represents a surface of a photograph card, such as a government-printed postcard or a commercially-printed postcard, on which an address will be written.

Reference numeral 7*b* represents a surface of a photograph sheet applied to the reverse side of the government-printed postcard or the commercially-printed postcard opposing the recording surface 7*a.*

Figure 9A:
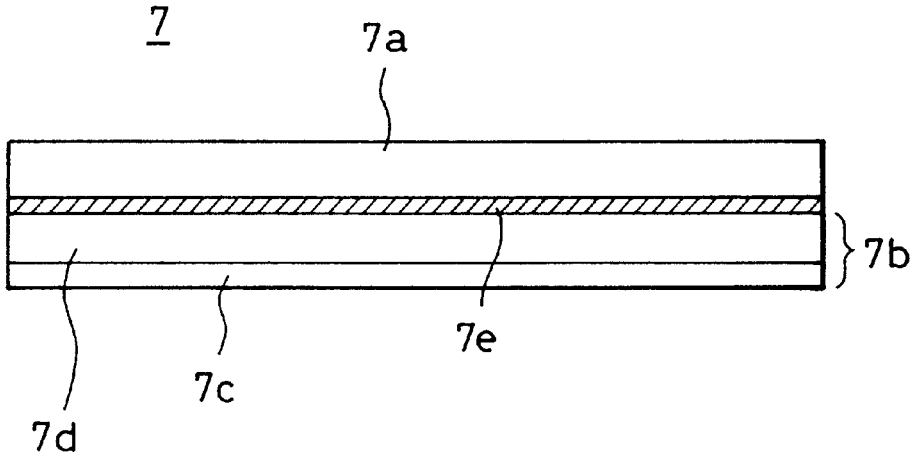
FIGS. 9(*a*) and 9(*b*) are a cross sectional views showing a state of a photograph postcard recorded and stacked in the word processor according to the embodiment of the present invention.

FIG. 9A shows the cross section of the photograph postcard 7.

The photograph postcard 7 is manufactured by applying the photograph sheet 7*b* to the reverse side of the government-printed postcard or a commercially-printed postcard 7*a* by using a pressure sensitive adhesive double coated sheet 7*e.*

The photograph sheet 7*b* comprises a photosensitive emulsion layer 7*c* applied to a base 7*d,* the surface of the base 7*d* being applied to the surface opposing the address side of the government-printed postcard or a commercially-printed postcard 7*a* by the pressure sensitive adhesive double coated sheet 7*e.*

When an address is recorded on a plurality of photograph postcards 7, the photograph postcard 7 is inserted into the recording apparatus 3 through the opening portion 4 in such a manner that the recording surface (the address side) 7*a* faces upwards as shown in FIG. 7 because the recording apparatus 3 for recording the upper surface of the recording sheet 5 is used in this embodiment.

Initially, an address is recorded on the first photograph postcard 7-1, and the photograph postcard 7-1 is discharged in the rear of the discharge port 3*j* of the recording apparatus 3 in such a manner that the address side 7*a* faces upwards, followed by being allowed to stand. Simultaneously, recording of the address on the second photograph postcard 7-2 starts.

After the address has been recorded on the second photograph postcard 7-2, the photograph postcard 7-2 is, through the discharge port 3*j*, discharged on the photograph postcard 7-1 allowed to stand in the rear of the discharge port 3*j*. Then, the photograph postcard 7-2 is placed on the photograph postcard 7-1 in such a manner that the surface of the photograph sheet on the photograph postcard 7-2 faces the address side 7*a* of the photograph postcard 7-1.

The timing, at which the second photograph postcard 7-2 is discharged, is determined to satisfy (time T required to make the contact>ink absorption time TF for the recording surface) to prevent generation of smear.

The address side 7*a* of the photograph postcard 7-1 is formed by a usual paper for a postcard and the ink absorption time TF is similar to that required for plain paper (5 seconds to 15 seconds at room temperature and humidity).

A fact was confirmed that, even if the condition (contact time T>ink absorption time TF) is satisfied, allowing to stand the recorded photograph postcard 7-1 and photograph postcard 7-2 with stacking results in the two photograph postcards adhere.

Figure 9B:
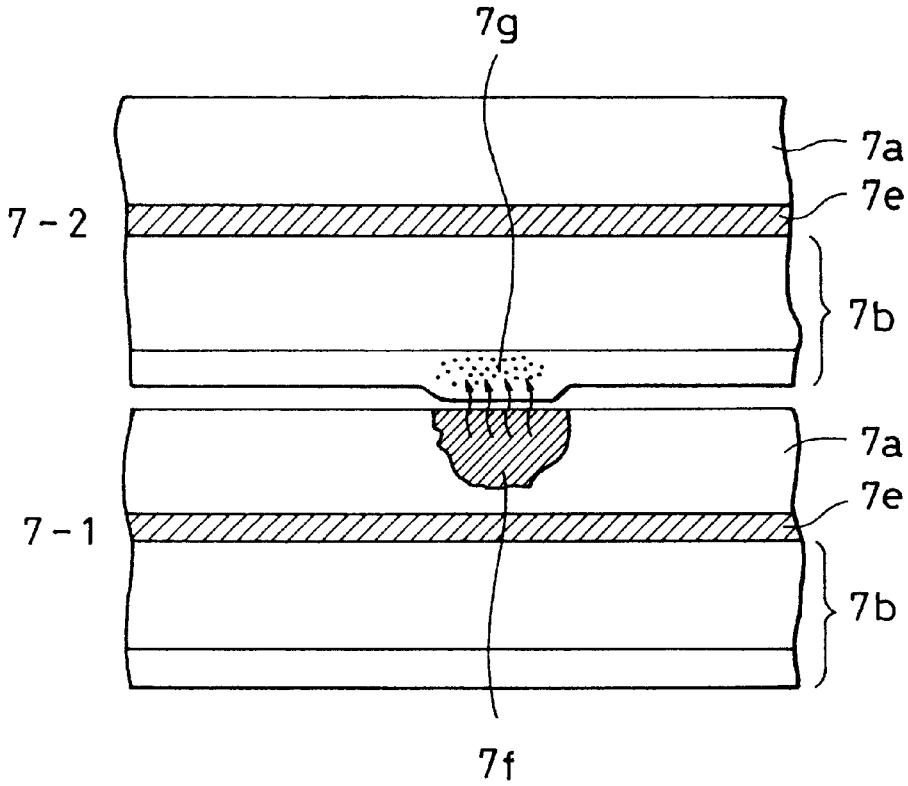

Referring to FIG. 9B, the adhesion phenomenon will now be described.

Referring to FIG. 9B, reference numerals 7-1 and 7-2 represent photograph postcards recorded and discharged through the discharge port 3*j* while being stacked.

Reference numeral 7*f* represents a portion of the recorded and discharged photograph postcard 7-1 to which ink has been discharged and on which information has been recorded, the portion being illustrated in the form of a cross section.

Ink discharged to the recording portion 7*f* is absorbed by the recording surface 7*a* of the photograph postcard 7-1, and then the information is recorded on the photograph postcard 7-2, and the photograph postcard 7-2 is discharged onto the photograph postcard 7-1.

However, evaporation of the solvent of the ink absorbed by the recording portion 7*f* is continued as illustrated even after the second photograph postcard 7-2 has been placed on the first photograph postcard 7-1. As a result, the ink is absorbed by an emulsion portion 7*g* of the photograph sheet 7*b* on the second photograph postcard 7-2 which is in contact with the recording portion 7*f* so that the emulsion is softened.

As known, the emulsion surface of a photograph sheet has a characteristic with which it adheres to a substance that is in contact with the emulsion in a state where the emulsion contains water and it is softened. Therefore, in the case shown in FIG. 9B, the photograph postcard 7-1 and photograph postcard 7-2 adhere to each other.

Figure 10:
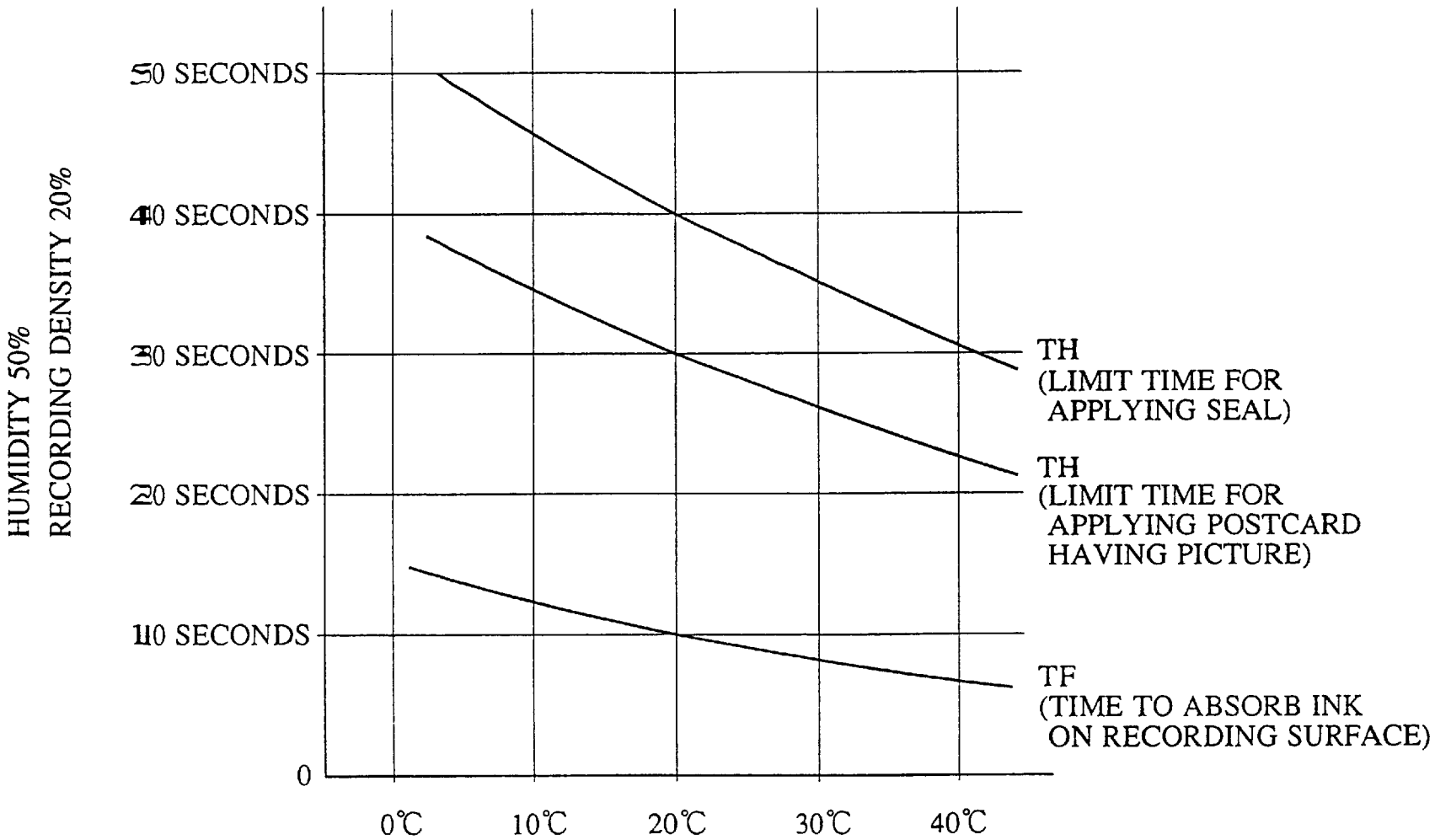
FIG. 10 is a graph showing the relationship among the ink absorption time for the recording surface, adhesion preventive limit time for a photograph postcard, adhesion preventive limit time for a seal and the atmospheric temperature.

FIG. 10 is a graph showing the ink absorption time TF for a photograph postcard and adhesion prevention limit time TH taken to prevent the adhesion phenomenon.

More specifically, FIG. 10 is a graph showing the ink absorption time TF and the adhesion prevention limit time TH when the humidity of the atmosphere is 50% and the recording density is 20%. When the temperature was 20° C., the ink absorption time TF for the recording surface was about 10 seconds and the adhesion prevention limit time TH for the photograph postcard was 30 seconds, which was about three times the ink absorption time ink absorption time TF. Furthermore, the adhesion prevention limit time TH for a seal was 40 seconds, which was about four times the ink absorption time ink absorption time TF.

The ink absorption time TF for the recording surface and the adhesion prevention limit time TH for the photograph postcard are lengthened in proportion to the humidity of the atmosphere.

To prevent the adhesion, the recording apparatus according to the present invention is controlled in such a manner that, if the recording apparatus has discriminated that the recording sheet is a photograph postcard, then the second photograph postcard 7-2, on which an address has been recorded, is, through the discharge port 3*j*, discharged on the photograph postcard 7-1 allowed to stand in the rear of the discharge port 3*j* at the timing at which the condition (time T taken to realize the contact>adhesion prevention limit time TH for a photograph postcard) is satisfied with which the foregoing adhesion phenomenon does not take place.

Referring to a flow chart shown in FIG. 11, the control operation according to this embodiment will now be described.

When information to be recorded has been input by using the keyboard 1, the printing menu shown in FIG. 5 is initially displayed to set a desired paper type from the paper type selection area, and then other printing conditions are set. The following description will be performed on the assumption that a photograph postcard is selected as the paper.

After printing menu has been set, the printing operation starts in step 11 of the flow chart.

After the printing operation has been started, the values detected by the temperature sensor 3*p* and the moisture sensor 3*q* are read in step 12.

The following description will be performed on the assumption that the temperature is 20° C. and the humidity is 50%.

In steps 13 to 15, the type of the paper set in the paper type selection area of the printing menu is discriminated. If plain paper has been set, ink absorption time TF for the recording surface adapted to a usual smear preventive control is performed in step 16, and then the printing operation is performed. If the OHP sheet has been set, ink absorption time TF for the recording surface adapted to an OHP smear preventive control is set in step 17, and then the printing operation is performed.

If the photograph postcard has been set as the type of the paper, the adhesion prevention limit time TH corresponding to the temperature and humidity detected in step 12 is, in step 18, read from the ROM 6*b* previously storing concerning values shown in FIG. 10.

After the adhesion prevention limit time TH has been set, the printing operation starts in step 20. When information has been recorded at the point 5*p* shown in FIG. 5, the timer TM 6*d* is started in step 21. In step 22 the recording density KM at the point 5*p* is detected in accordance with the information to be recorded. In step 23 correction value KH corresponding to the recording density KM is set. Note that the point 5*p* is previously set in accordance with the type of the recording medium.

Figure 12:
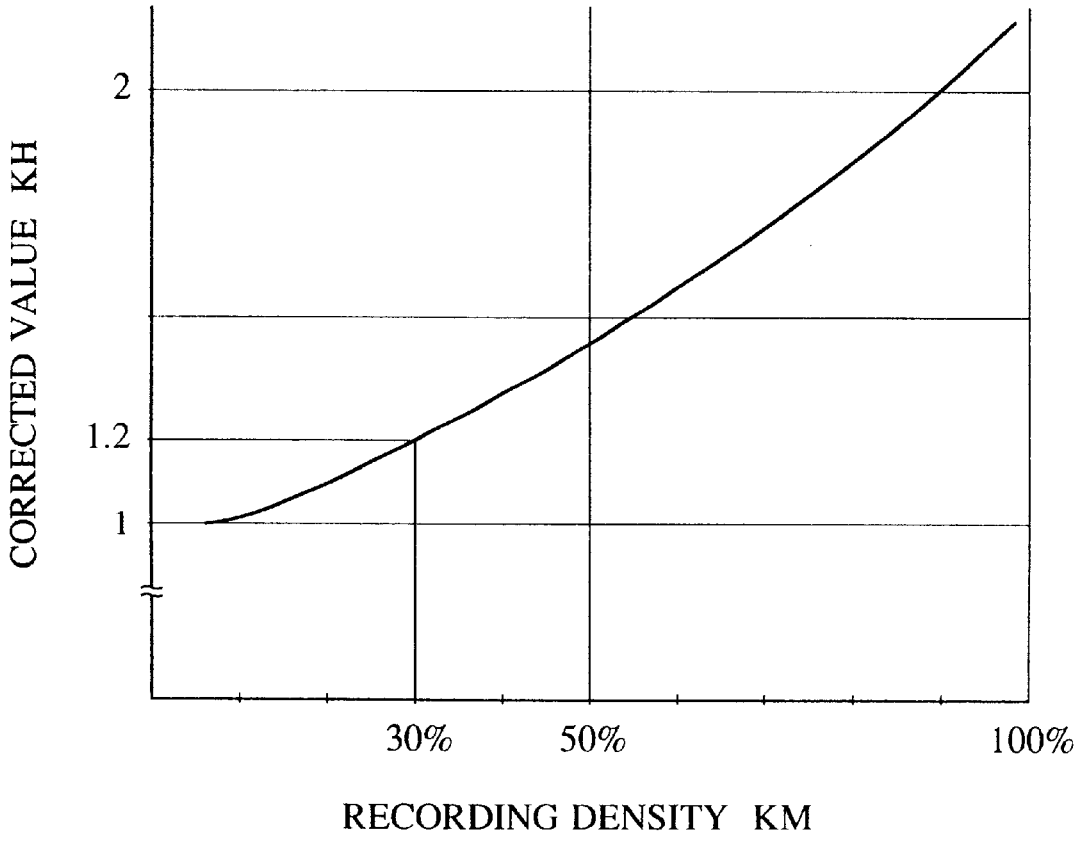
FIG. 12 is a graph showing the relationship between recording density and the correction value KH for adhesion prevention limit time TH.

The correction value KH has the relationship with the recording density KM as shown in a graph in FIG. 12 such that the correction value KH is, in this embodiment, 1.2 when the recording density is 30%.

Also the relationship between the recording density KM and the correction value KH shown in FIG. 12 is stored in the ROM 6*b* similarly to the adhesion prevention limit time TH.

If photograph postcards are recorded, the leading portion of the recorded photograph postcard 7-2 is not dangled as shown in FIG. 7 and does not come in contact with the first photograph postcard 7-1 until after the second photograph postcard 7-2 has been discharged. Therefore, the point 5*p* is the final recording line of the photograph postcard 7-1.

After the first photograph postcard 7-1 has been recorded and discharged in step 24, the second photograph postcard 7-2 is set manually or by using an automatic paper feeder. In step 25 recording of information on the second photograph postcard 7-2 starts.

After information has been, in step 26, recorded on the second photograph postcard 7-2 to one line before an assumed position, at which the leading portion of the second photograph postcard 7-2 is brought into contact with the first photograph postcard 7-1, a discrimination is performed whether or not the time TM from a moment, at which information has been recorded at point 5*p* of the first photograph postcard 7-1, is long enough to prevent the adhesion phenomenon.

In this embodiment, in a case where TM<TH×KH, that is TM≦30 seconds×1.2=36 seconds, ensuing recording or feeding of the recording sheet is temporarily interrupted in step 28. After the relationship TM>36 seconds has been established, ensuing recording or feeding of the recording sheet is restarted in step 29. When recording has been completed, the recorded recording sheet is discharged in step 30. Then, recording of the third recording sheet and ensuing sheets is performed in accordance with the foregoing flow chart.

Since the photograph postcard does not come in contact with the discharged photograph postcard during the recording operation, the interruption to be performed in step 28 means paper discharge to be performed after the relationship TM>36 has been held after information had been recorded on the second photograph postcard 7-2.

Since the recording apparatus is controlled as described above, adhesion of the discharged and stacked recording sheets can be prevented.

Although the foregoing description has been performed about the operation to be performed in the case where photograph postcards are used as the recording sheets, this embodiment may be adapted to a process of recording information on a seal-type recording sheet formed by applying water-soluble glue of the same type as that for use on a stamp to plain paper and by drying the glue.

Since the glue applied to the reverse side of a seal has strong adhesiveness as compared with that of the emulsion for the photograph sheet, the adhesion prevention limit time TH is 40 seconds at 20° C., which is about 1.3 to 1.4 times that for the photograph postcard, as shown in FIG. 10.

Figure 11A:
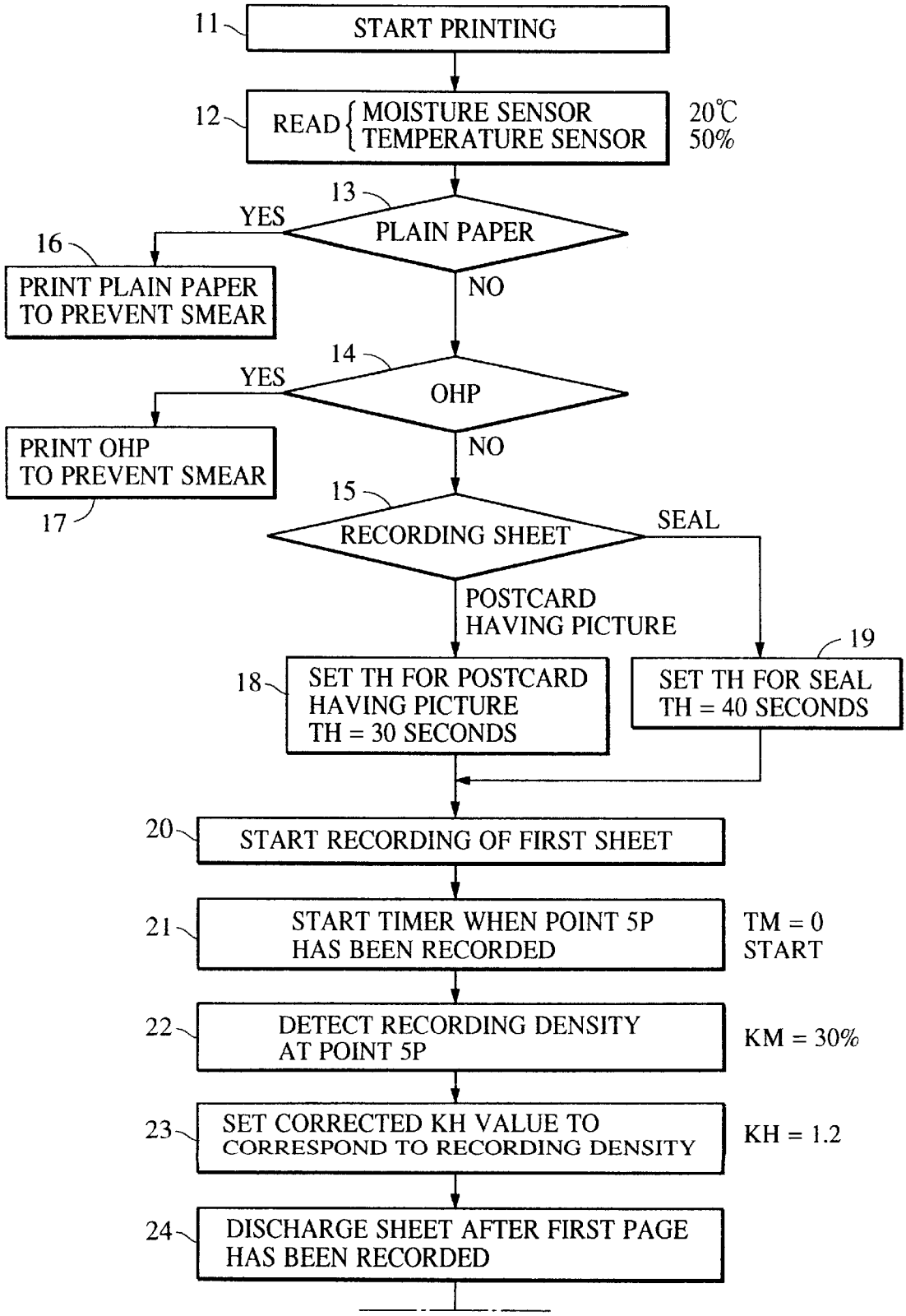
FIG. 11, which is comprised of FIGS. 11A and 11B, is a flow chart showing control of the recording operation according to the present invention.
Figures 11, 11B:
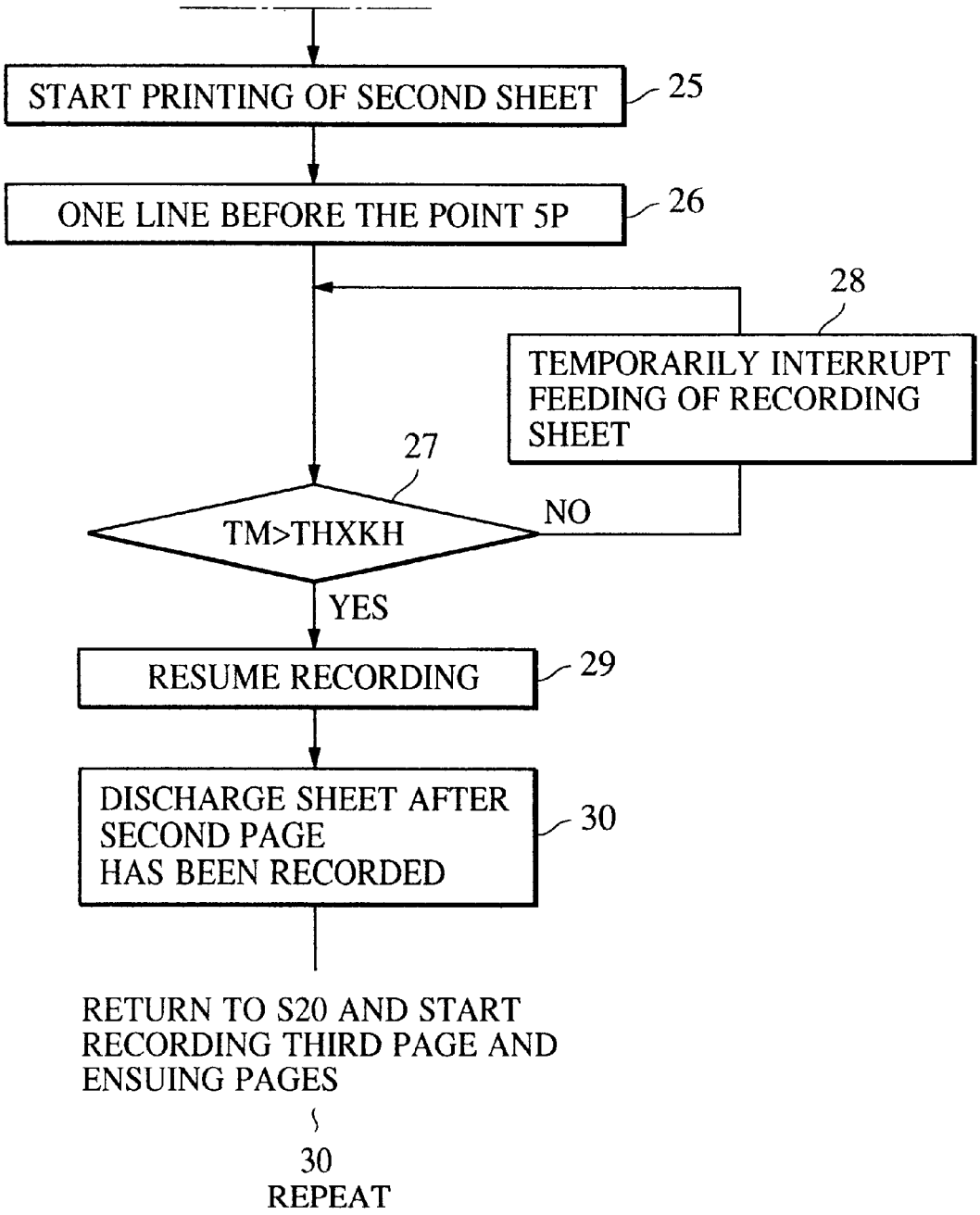

If the seal is selected in the printing menu shown in FIG. 5, the adhesion prevention limit time TH for the seal must be set to 40 seconds in step 19 shown in FIG. 11. Since the leading portion of the recording sheet 5-2 dangles during the recording operation as shown in FIG. 6 and the recording sheet 5-2 comes in contact with the first seal 5-1 at the point 5*p*, the temporal interruption in step 28 shown in FIG. 11 causes the recording operation to be temporarily interrupted and the recording operation to restart when TM>TH×1.2=48 seconds.

Second Embodiment

Although the recording apparatus according to the present invention has a structure in which the recording surface faces upwards and the second and ensuing recording sheets are stacked on the recording surface of the first recording sheet, the present invention can be adapted to a structure in which the recording surface faces downwards.

In the foregoing case, the point 5*p* of the recording surface of the second recording sheet first comes in contact with the first recording sheet. Thus, the timer TM can be started at the moment, at which information is recorded at the point 5*p* of the second recording sheet, so as to control the contact time.

Although the photograph postcard and the seal have been described in the foregoing embodiments, the present invention can be widely adapted to recording sheets like a photograph sheet of the type having a reverse side comprising a material that absorbs a solvent evaporating from the ink and adheres to the sheet.

As described above, a recording apparatus can be realized which is capable of preventing reaction and adhesion of the solvent evaporating from the ink used in the recording operation to the reverse side of the stacked recording sheets in the case where a plurality of recorded recording sheets are stacked, and preventing the foregoing problem if recording sheets of a type having reverse sides which are processed in a special manner are used.

Among the ink jet recording methods, a recording apparatus of a type having an arrangement that heat energy is utilized to form a flying fluid droplet so as to perform the recording operation has been described.

As for the typical structure and the principle, it is preferable that the basic structure disclosed in, for example, U.S. Pat. Nos. 4,723,129 or 4,740,796 is employed. The aforesaid method can be adapted to both a so-called on-demand type apparatus and a continuous type apparatus. In particular, a satisfactory effect can be obtained when the on-demand type apparatus is employed because of the structure arranged in such a manner that one or more drive signals, which rapidly raise the temperature of an electricity-to-heat converter disposed to face a sheet or a fluid passage which holds the fluid (ink) to a level higher than levels at which nucleate boiling takes place are applied to the electricity-to-heat converter so as to generate heat energy in the electricity-to-heat converter and to cause at the heat effecting surface of the recording head film boiling to take place so that bubbles can be formed in the fluid (ink) to correspond to the one or more drive signals. The enlargement/contraction of the bubble will cause the fluid (ink) to be discharged through a discharging opening so that one or more droplets are formed. If a pulse shaped drive signal is employed, the bubble can be enlarged/contracted immediately and properly, causing a further preferred effect to be obtained because the fluid (ink) can be discharged with excellent responsiveness.

It is preferable that a pulse drive signal disclosed in U.S. Pat. Nos. 4,463,359 or 4,345,262 is employed. If conditions disclosed in U.S. Pat. No. 4,313,124, which relates to the temperature rising ratio at the heat effecting surface, are employed, a satisfactory recording result can be obtained.

As an alternative to the structure (linear fluid passage or perpendicular fluid passage) of the recording head disclosed in each of the aforesaid inventions and having an arrangement that discharge ports, fluid passages and electricity-to-heat converters are combined, a structure having an arrangement that the heat effecting surface is disposed in a bent region as disclosed in U.S. Pat. Nos. 4,558,333 or 4,459,600 may be employed.

In addition, the following structures may be employed: a structure having an arrangement that a common slit is formed to serve as a discharge section of a plurality of electricity-to-heat converters as disclosed in Japanese Patent Laid-Open No. 59-123670; and a structure in which an opening for absorbing pressure waves of heat energy is disposed to correspond to the discharge section as disclosed in Japanese Patent Laid-Open No. 59-138461.

A chip type recording head which can be electrically connected to the body of the apparatus or to which ink can be supplied from the body of the apparatus when it is fastened to the body of the apparatus may be employed. Furthermore, a cartridge recording head having an ink tank integrally formed with the recording head may be employed.

It is preferred to additionally employ the recording head restoring means and an auxiliary means provided as the component of the present invention because the effect of the present invention can be further stabilized. Specifically, it is preferable to employ any combination of a recording head capping means, a cleaning means, a pressurizing or suction means, an electricity-to-heat converter, an auxiliarly heating element or a sub-heating means constituted by combining the converter and the auxiliary heating element for effecting a sub-discharge mode in which a discharge is performed independently from the recording discharge in order to stably perform the recording operation.

The recording apparatus may be arranged to be capable of recording a color-combined image composed of different colors or a full color image obtained by mixing colors to each other by integrally forming the recording head or by combining a plurality of recording heads as well as recording only a main color such as black.

Although a fluid ink is employed in each of the aforesaid embodiments of the present invention, ink which is solidified at room temperature or lower and as well as softened at room temperature, or ink in the form of a fluid at room temperature, or ink which is formed into a fluid when the recording signal is supplied may be employed because the aforesaid ink jet recording method is ordinarily designed in such a manner that the temperature of ink is controlled in a range from 30° C. to 70° C. so as to keep the viscosity of the ink in a stable discharge range.

Furthermore, ink of the following types can be adapted to the present invention: ink which is liquified when heat energy is supplied in response to the recording signal so as to be discharged in the form of fluid ink, the aforesaid ink being exemplified by ink, the temperature rise of which due to supply of the heat energy is positively prevented by utilizing the temperature rise as energy of state change from the solid state to the liquid state; and ink which is solidified when it is unused for the purpose of preventing the ink evaporation. Furthermore, ink which is first liquified when supplied with heat energy may be adapted to the present invention. In the aforesaid case, the ink may be of a type which is held as fluid or solid material in a recess of a porous sheet or a through hole at a position to face the electricity-to-heat converter as disclosed in Japanese Patent Laid-Open No. 54-56847 or Japanese Patent Laid-Open No. 60-71260. It is most preferred that the ink be adapted to the aforesaid film boiling method.

The recording apparatus according to the present invention may be in the form of an integrated or individual image output terminal equipment of the information processing apparatus, such as the foregoing word processor or a computer, in the form of a facsimile apparatus or in the form of a copying machine combined with a reader.

The present invention is not limited to the structure, in which ink droplets are discharged by using heat energy, but the present invention may be adapted to a structure in which a piezoelectric device or the like is employed to discharge ink droplets.

Although the invention has been described in its preferred form with a certain degree of particularity, it is understood that the present disclosure of the preferred form can be changed in the details of construction and the combination and arrangement of parts may be resorted to without departing from the spirit and the scope of the invention as hereinafter claimed.

What is claimed is:

1. A recording apparatus for recording an image on a recording medium by discharging an ink droplet in accordance with information to be recorded and discharging the recorded recording medium to a predetermined position, said recording apparatus comprising:

discrimination means for discriminating a type of the recording medium, wherein a recording surface and a non-recording surface of one type of the recording medium are formed of different materials;

setting means for setting a predetermined time in accordance with the type of the recording medium discriminated by said discrimination means in which to prevent contact between the non-recording or recording surface of a recorded recording medium and the recording or non-recording surface of a discharged recording medium, said setting means comprises memory means which stores data relating to the predetermined time in accordance with the type of the recording medium, reads corresponding data from said memory means in accordance with the type of the recording medium which is discriminated by said discrimination means and sets the predetermined time in accordance with read data; and control means for controlling one of an operation of recording the recording medium and an operation of discharging the recording medium in order to prevent contact between the surface of the recorded recording medium and the discharged recording medium for the predetermined time set by said setting means, wherein the predetermined time is set to be longer than a time limit which is necessary to prevent adhesion between the surface of the recorded recording medium and the discharged recording medium, and the time limit is longer than a time period necessary to absorb the ink discharged on the recording surface of the recording medium.

2. A recording apparatus according to claim 1, wherein said control means interrupts said recording operation of the recording medium for discharging the recording medium in accordance with said predetermined time.

3. A recording apparatus according to claim 1, wherein said setting means sets said predetermined time in accordance with the type of the recording medium and atmospheric conditions.

4. A recording apparatus according to claim 3, wherein said control means further corrects said predetermined time in accordance with a recording density.

5. A recording apparatus according to claim 1, wherein said control means controls recording of an image on a recording medium of a type having a reverse side on which a photograph sheet is disposed.

6. A recording apparatus according to claim 5, wherein, if said discrimination means has discriminated that the recording medium is a recording medium having the reverse side provided with a photograph sheet, said setting means sets said predetermined time to be greater than the time limit for which adhesion of a surface of said photograph sheet and a recording surface of another recording medium can be prevented.

7. A recording apparatus according to claim 1, wherein heat energy is used to change the state of ink to discharge an ink droplet through discharge ports.

8. A recording apparatus for recording an image on a recording medium by discharging an ink droplet in accordance with information to be recorded and discharging the recorded recording medium to a predetermined position, said recording apparatus comprising:

selection means for selecting one of a first recording medium having a non-recording surface provided with a photograph sheet and a second recording medium which is different from said first recording medium; and elongating means for, if said first recording medium is selected, elongating a discharge interval between a sheet of said first recording medium and a previously discharged sheet as compared with a discharge interval in a case where said second recording medium is selected, wherein said elongating means elongates the discharge interval of said first recording medium in accordance with a time limit with which adhesion of a surface of said photograph sheet of said first recording medium and a recording surface of the previously discharged sheet can be prevented, the time limit being longer than a time period to absorb ink discharged on a recording surface of the previously discharged sheet.

9. A recording apparatus according to claim 8, wherein said elongating means changes the discharge interval in accordance with atmospheric conditions.

10. A recording apparatus according to claim 9, wherein said elongating means further changes the discharge interval in accordance with a recording density.

11. A recording apparatus according to claim 8, wherein said elongating means elongates the discharge interval by interrupting an operation of recording information on said first recording medium.

12. A recording apparatus according to claim 8, wherein said elongating means elongates the discharge interval by interrupting an operation of conveying said first recording medium.

13. A recording apparatus according to claim 8, wherein heat energy is used to change the state of ink to discharge an ink droplet through discharge ports.

14. A recording apparatus according to claim 9, wherein said elongating means changes the discharge interval in accordance with atmospheric conditions.

15. A recording apparatus according to claim 14, wherein said elongating means further changes the discharge interval in accordance with a recording density.

16. A recording apparatus according to claim 1, wherein said control means interrupts conveying the recording medium for discharging the recording medium in accordance with the predetermined time.

17. A recording apparatus according to claim 1, wherein said discrimination means comprises means through which a user selects the recording medium from a plurality of recording mediums.

18. A recording apparatus according to claim 8, wherein said selection means comprises means through which a user selects one of the first recording medium and the second recording medium.

19. A recording apparatus for recording an image on a recording medium by discharging an ink droplet in accordance with information to be recorded and discharging the recorded recording medium to a predetermined position, said recording apparatus comprising:

discrimination means for discriminating a type of the recording medium, wherein a recording surface and a non-recording surface of one type of the recording medium are formed of different materials;

setting means for setting a predetermined time in accordance with the type of the recording medium discriminated by said discrimination means in which to prevent adhesion between a surface of a recorded recording medium that faces a discharged recording medium; and control means for controlling one of an operation of recording the recording medium and an operation of discharging the recording medium in order to prevent adhesion between the non-recording surface or the recording surface of the recorded recording medium and the recording surface or the non-recording surface of the discharged recording medium for the predetermined time set by said setting means, wherein the predetermined time is set to be longer than a time limit which is necessary to prevent the adhesion between the surface of the recorded recording medium and the discharged recording medium, and the time limit is longer than a time period necessary to absorb the ink discharged on the recording surface of the recording medium.

20. A recording apparatus according to claim 19, wherein said control means interrupts the recording operation of the recording medium for discharging the recording medium in accordance with the predetermined time.

21. A recording apparatus according to claim 19, wherein said setting means sets the predetermined time in accordance with the type of the recording medium and atmospheric conditions.

22. A recording apparatus according to claim 21, wherein said control means further corrects said predetermined time in accordance with a recording density.

23. A recording apparatus according to claim 19, wherein said control means controls recording of an image on a recording medium of a type having a reverse side on which a photograph sheet is disposed.

24. A recording apparatus according to claim 23, wherein, if said discrimination means has discriminated that the recording medium is a recording medium having the reverse side provided with a photograph sheet, said setting means sets said predetermined time to be greater than the time limit for which adhesion of a surface of said photograph sheet and a recording surface of another recording medium can be prevented.

25. A recording apparatus according to claim 19, wherein heat energy is used to change the state of ink to discharge the ink droplet through discharge ports.

26. A recording apparatus for recording an image on a recording medium by discharging an ink droplet in accordance with information to be recorded and discharging the recorded recording medium to a predetermined position, said recording apparatus comprising:

discrimination means for discriminating a type of the recording medium;

setting means for setting a predetermined time in accordance with the type of the recording medium discriminated by said discrimination means in which to prevent contact between a surface of a recorded recording medium and a surface of a discharged recording medium; and control means for controlling one of an operation of recording the recording medium and an operation of discharging the recording medium in order to prevent contact between the surface of the recorded recording medium and the surface of the discharged recording medium for the predetermined time set by said setting means, wherein said control means does not control the operations for the first page of the recording medium and does control the operations for subsequent pages of the recording medium after the first page of the recording medium.

27. A recording apparatus according to claim 26, wherein said control means interrupts the operation of discharging the recording medium in accordance with the predetermined time.

28. A recording apparatus according to claim 26, wherein said setting means sets the predetermined time in accordance with the type of the recording medium and atmospheric conditions.

29. A recording apparatus according to claim 28, wherein said control means further corrects the predetermined time in accordance with a recording density.

30. A recording apparatus according to claim 26, wherein said control means controls recording of an image on a recording medium of a type having a reverse side on which a photograph sheet is disposed.

31. A recording apparatus according to claim 30, wherein, if said discrimination means has discriminated that the recording medium is the recording medium having the reverse side provided with a photograph sheet, said setting means sets the predetermined time to a time limit for which adhesion of a surface of the photograph sheet and a recording surface of another recording medium can be prevented.

32. A recording apparatus according to claim 26, wherein heat energy is used to change the state of ink to discharge an ink droplet through discharge ports.

* * * * *

UNITED STATES PATENT AND TRADEMARK OFFICE

CERTIFICATE OF CORRECTION

PATENT NO. : 6,015,201

DATED : January 18, 2000

INVENTOR(S) : ASAKURA

It is certified that error appears in the above-identified patent and that said Letters Patent is hereby corrected as shown below:

IN THE DRAWINGS:

Sheet 4, Figure 4, "LONGTITUDE" (all occurrences) should read --LONGITUDE--.

Sheet 5, Figure 5, "PLACES" should read --PLACED--.

COLUMN 3:

Line 44, "a" should be deleted.

COLUMN 7:

Line 35, "adhere." should read --adhering.--.

COLUMN 8:

Line 8, "ink absorption time" (second occurrence) should be deleted.

Line 11, "ink absorption time" should be deleted.

COLUMN 11:

Line 18, "auxiliarly" should read --auxiliary-.

COLUMN 14:

Line 67, "the" should read --the one of the--.

UNITED STATES PATENT AND TRADEMARK OFFICE

CERTIFICATE OF CORRECTION

PATENT NO. : 6,015,201

DATED : January 18, 2000

INVENTOR(S) : ASAKURA

It is certified that error appears in the above-identified patent and that said Letters Patent is hereby corrected as shown below:

COLUMN 15:

Line 2, "the" should read --the one of the--.

Signed and Sealed this

First Day of May, 2001

*Attest:*

NICHOLAS P. GODICI

*Attesting Officer*

*Acting Director of the United States Patent and Trademark Office*